US005127490A

United States Patent [19]

Sheu

[11] Patent Number: 5,127,490

[45] Date of Patent: Jul. 7, 1992

[54] EMERGENCY DESCENT DEVICE

[76] Inventor: Por-Jiy Sheu, 3, 11F-7, Fu-Shin Erh Rd., Lin-Ya Dist., Kaohsiung City, Taiwan

[21] Appl. No.: 748,437

[22] Filed: Aug. 22, 1991

[51] Int. Cl.[5] ..... A62B 1/08

[52] U.S. Cl. ..... 182/5; 182/236; 182/241; 188/65.4

[58] Field of Search ..... 182/5, 6, 7, 231, 236, 182/241; 188/65.5, 65.4

[56] References Cited

U.S. PATENT DOCUMENTS

| | | | |
|---|---|---|---|
| 699,558 | 5/1902 | Orthmann | 182/241 |
| 1,116,434 | 11/1914 | Johansson | 182/241 |
| 1,190,483 | 7/1916 | Tibbals | 182/241 |
| 4,000,881 | 1/1977 | Matsumoto | 182/241 |
| 4,157,127 | 6/1979 | Katsube | 188/65.5 |
| 4,470,480 | 9/1984 | Celez | 182/5 |
| 4,494,629 | 1/1985 | Raeburn | 188/65.5 |
| 4,662,475 | 5/1987 | Rutschi | 182/5 |

*Primary Examiner*—Reinaldo P. Machado
*Attorney, Agent, or Firm*—Cushman, Darby & Cushman

[57] ABSTRACT

An emergency descent device includes a casing, a rotation retarding device, a suspension gear pulley, a cable extending around the suspension gear pulley and a cable guiding unit. The cable guiding unit includes a pair of spaced upper rollers and a lower roller provided under a point between the two spaced rollers. A cable has a descending portion and an ascending portion, which is frictionally passed around the suspension gear pulley. Each of the two end portions of a cable pass between one of the pair of spaced rollers and the lower roller. When one end of the cable is pulled, an additional frictional force occurs which arrests the fall of the pulled end of the cable.

7 Claims, 9 Drawing Sheets

EMERGENCY DESCENT DEVICE

BACKGROUND OF THE INVENTION

1. Field of Invention

The invention relates to a descent device, more particularly to an emergency descent device which is suitable for use by people for the purpose of safely, reliably and easily descending from a height in case of fire.

2. Description of the Related Art

Up to present time, whenever a fire breaks out in a many storied building, people are often suffocated to death by smoke while they try to escape from the fire.

Even a building equipped with an emergency staircase, it does not follow that all people can successfully escape from a fire. Since most safety ladders or staircases are not properly maintained in normal condition, and often the safety staircase serves as storage space. In case of a fire, objects stored there block the escape route from the building.

Furthermore, the normal safety procedure when a fire breaks out in a tall-building, is to first cut the electricity so as to reduce dangers related to electric wire connections. If the fire escape lift provided in the tall-building is electrically operated, such a procedure would render the lift useless thereby trapping people in the burning rooms.

SUMMARY OF THE INVENTION

Therefore, the main object of the present invention is to provide an emergency descent device by which people can descend safely, reliably and easily from a height in case of a fire. Another object of the present invention is to provide an emergency descent device with a simple construction at a low cost.

Still another object of the present invention is to provide an emergency descent device which can be easily installed in a tall building and removed when not in use.

According to this invention, an emergency descent device that includes a casing having a first and a second portion, a fastening device attached to the casing by which to attach the emergency descent device to a tall building when in use. Said device also includes a rotating shaft journalled in said first portion and having one end extending into the second portion. An active gear is sleeved rigidly on said extending end. A rotation retarding assembly is fixed to the rotating shaft in the first portion. The rotation retarding assembly includes a hollow tubular member having an internal toothed surface and an opening confined by said internal toothed surface, a first retarding member, a second retarding member and an external toothed sleeve member. The hollow tubular member is provided in said first portion with the rotating shaft passing through the same. The first retarding member includes a plurality of arms, each with a first toothed roller at its apexes thereof, and is fixed to the rotating shaft in the tubular member whereat the first roller is meshed with the internal toothed surface of the tubular member. The second retarding member that includes a plurality of arms each with a second toothed roller at its apexes thereof, and is fixed to the toothed sleeve member. The toothed sleeve member is rotatably sleeved over the rotating shaft in the tubular member adjacent to the first retarding member in such a manner that the second toothed roller is between a pair of adjacent first toothed rollers whereat the first toothed roller is meshed with the toothed sleeve member and the second toothed roller is meshed with the internal toothed surface of the tubular member. A suspension pulley having an active gear sleeved rigidly thereon is journalled in the second portion with the active gear being meshed with the inactive gear of the rotating shaft. A cable guiding unit that includes a pair of upper rollers and a central roller and is securely attached in the second portion underneath the suspension pulley. A pair of lower rollers is fixed in the second portion underneath the central roller on both sides of the central roller. The lower rollers and the upper roller cooperatively define a substantially rectangular shape with said central roller at the middle of the rectangular shape. A cable extends around and frictionally engages with the suspension pulley and has a descending portion and an ascending portion each of which extends between one of the pair of upper rollers and the central roller and between the central roller and one of the lower rollers so that when a free end of the descending portion is pulled, the ascending portion of the cable between the other one of the pair of upper rollers and the central roller and between the central roller and the other one of the lower roller straightens, and correspondingly moves at least the central roller with respect to the secured point of the cable guiding unit in the second portion.

BRIEF DESCRIPTION OF THE DRAWINGS

Other features and advantages of the present invention will become more apparent in the following detailed description, including the accompanying drawings, all of which show a non-limiting form of the invention, and of which.

DETAILED DESCRIPTION OF THE PREFERRED EMBODIMENT

Figure 1:
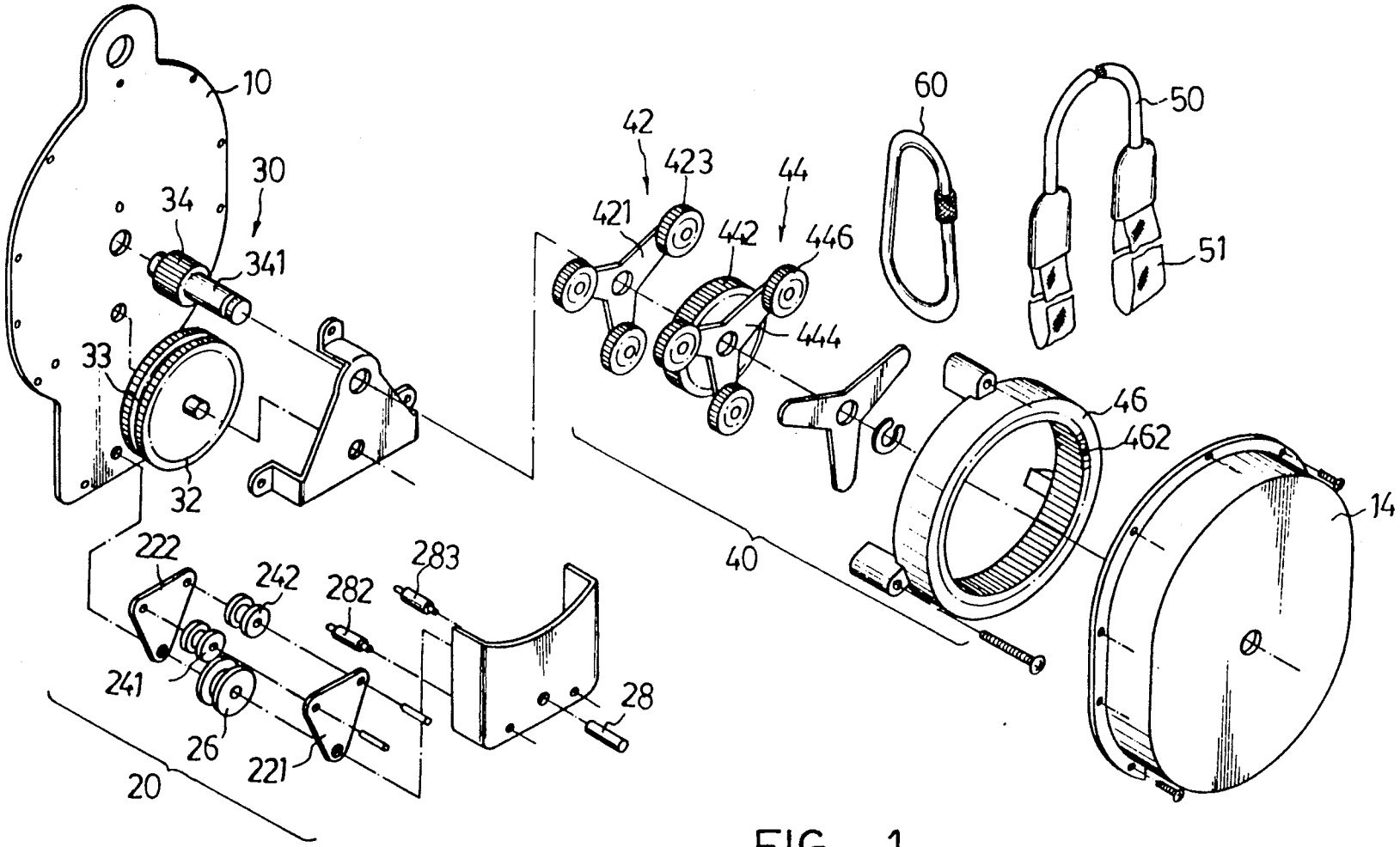
FIG. 1 is an exploded view of an emergency descent device in accordance with the present invention.
Figure 2:
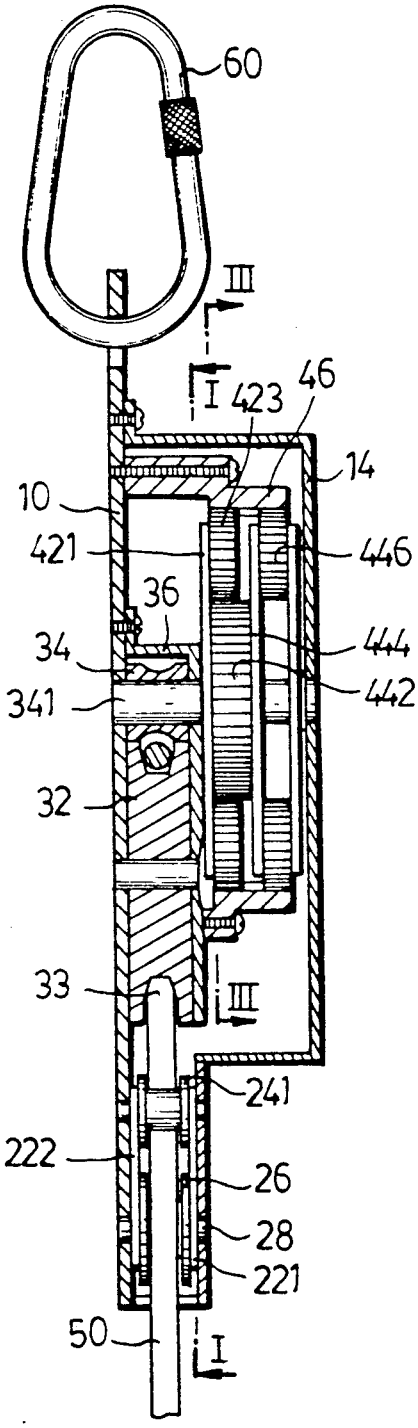
FIG. 2 is a cross sectional view of the emergency descent device of FIG. 1.

Referring to FIGS. 1 and 2, an emergency descent device of this invention includes a casing having a fist portion 14 and a second portion 10, a rotation retarding assembly 40, a gear unit 30, a cable guiding unit 20, a cable unit 50 and a fastening ring 60 to be attached to a tall building when in use.

Figure 5:
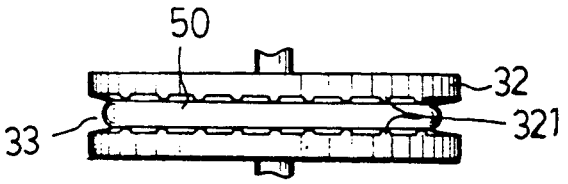
FIG. 5 shows the cross sectional view of the first preferred embodiment of the emergency descent device of FIG. 3 taken along the line II—II.
Figure 6:
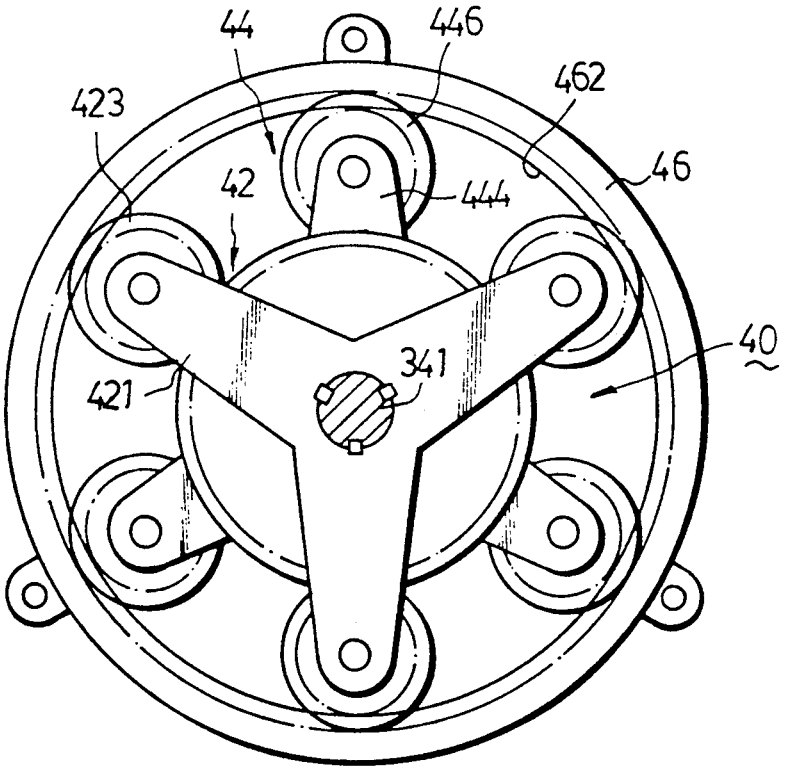
FIG. 6 shows the cross sectional view of the rotation retarding assembly of the preferred embodiment of the emergency descent device of the FIG. 1.

Referring to FIGS. 2, 5 and 6, a rotating shaft 341 is journalled in the first portion 14 of the casing with one end of the rotating shaft extending into the second portion. The rotation retarding assembly 14 that includes a hollow tubular member 46 having an internal toothed surface 462 and an opening confined by said internal toothed surface with the rotating shaft 341 passing through the tubular member 46, a first retarding member 42, an external toothed sleeve member 442 and a second retarding member 44. The first retarding member 42 includes a plurality of arms 421 each with a first toothed roller 423 at its apexes thereof, is fixed securely to the rotating shaft 341 in the opening of the tubular member 46 whereat each of the first toothed roller 423 is meshed with the internal toothed surface 462. The second retarding member 44 includes a plurality of arms 444 each with a second toothed roller 446 at its apexes thereof, is attached to the toothed sleeve member 442, which is rotatably sleeved on the rotating shaft adjacent to the first retarding member 42 in the tubular member 46 whereat the second toothed roller 446 is between a pair of adjacent first toothed rollers 423, the first toothed roller is meshed with the toothed sleeve member 442 and the second toothed roller 446 is meshed with the internal toothed surface of the tubular member 46. Thus arranged, the rollers 423,446 and the toothed surfaces will provide a frictional force in-between when the rotating shaft 341 is rotated. The faster the rotating shaft 341 rotates the greater the frictional force will become.

The gear unit 30 includes an inactive gear 34 sleeved rigidly on the rotating shaft 341 an active gear 33 sleeved rigidly on the pulley shaft of a suspension pulley 32 (see in FIG. 1) in the second portion 10 of the casing. The suspension pulley 32 further has a circumferential toothed recess 321 formed therearound which can frictionally hold a cable 50 passing around it as shown in FIG. 5.

Figure 7:
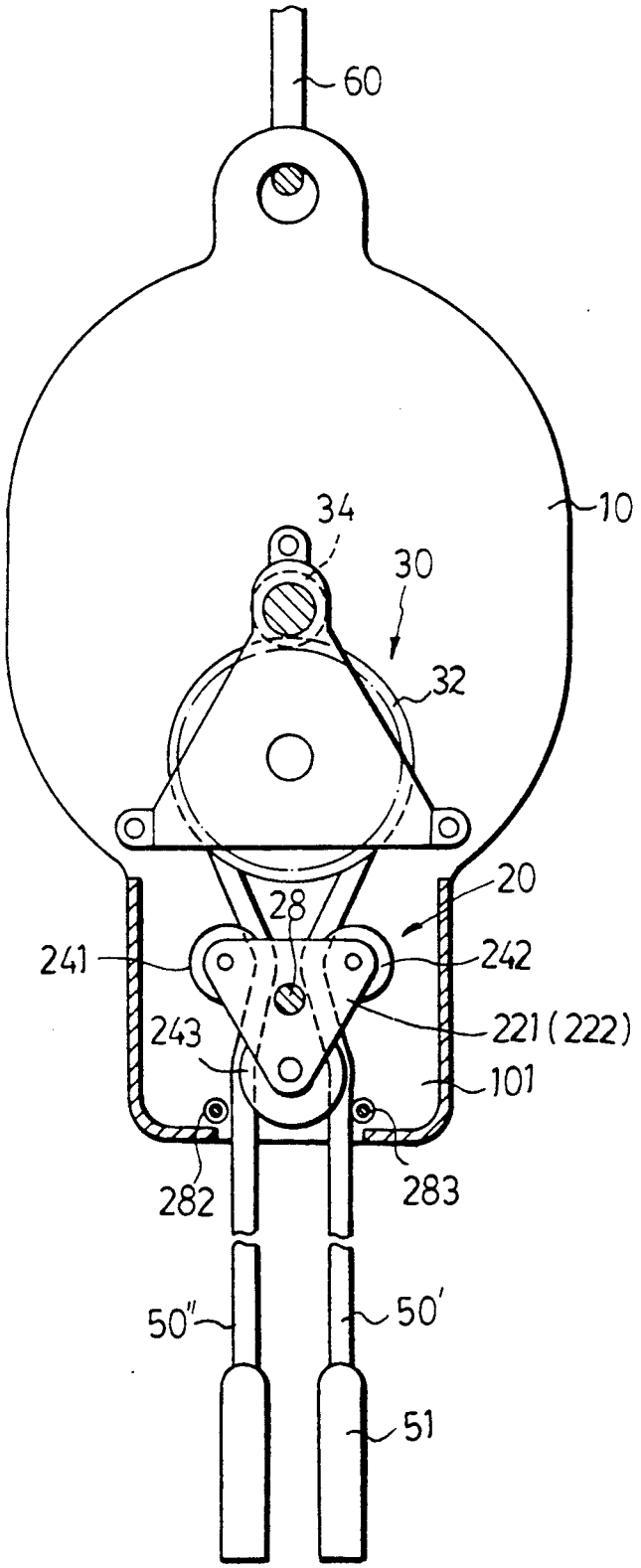
FIG. 7 is a cross sectional view of a second preferred embodiment of the emergency descent device of the present invention, illustrating the configuration before the descending portion of the cable is pulled.
Figure 8:
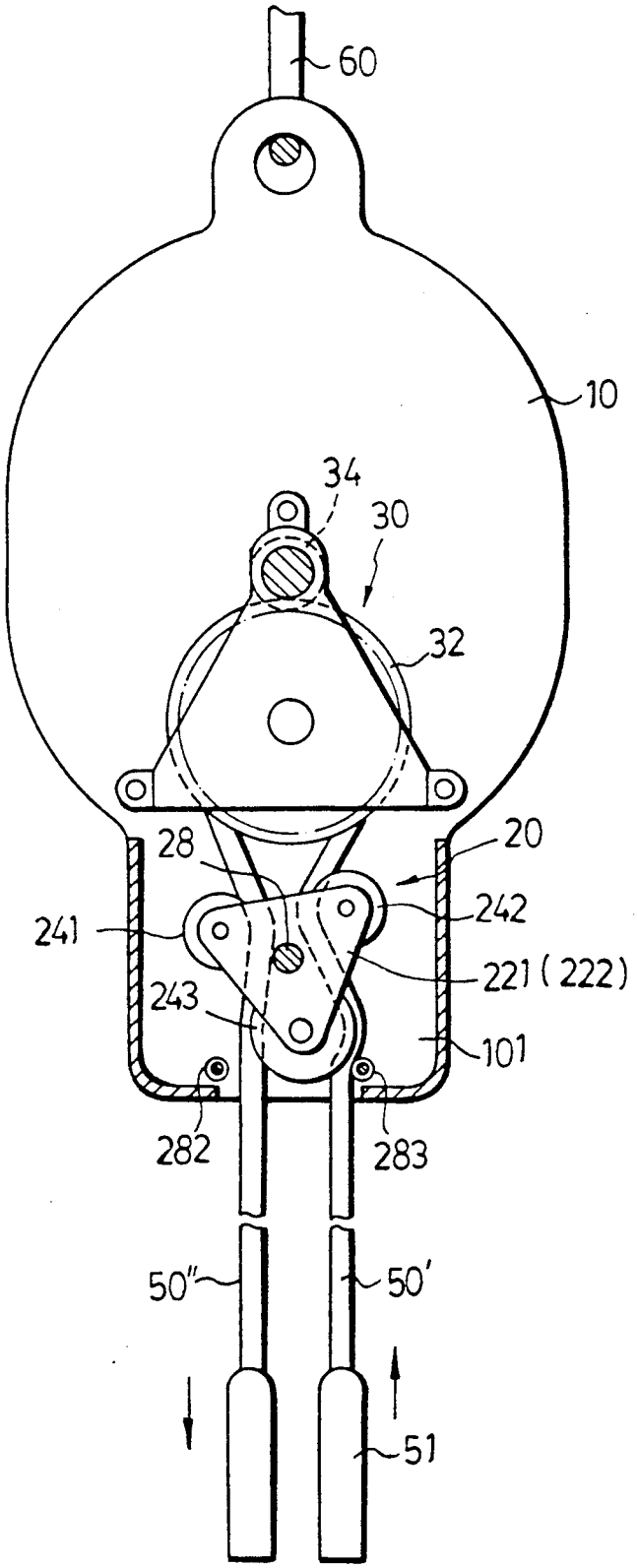
FIG. 8 is a cross sectional view of the second preferred embodiment of the emergency descent device of the present invention, illustrating the configuration after the descending portion of the cable is pulled.
Figure 9:
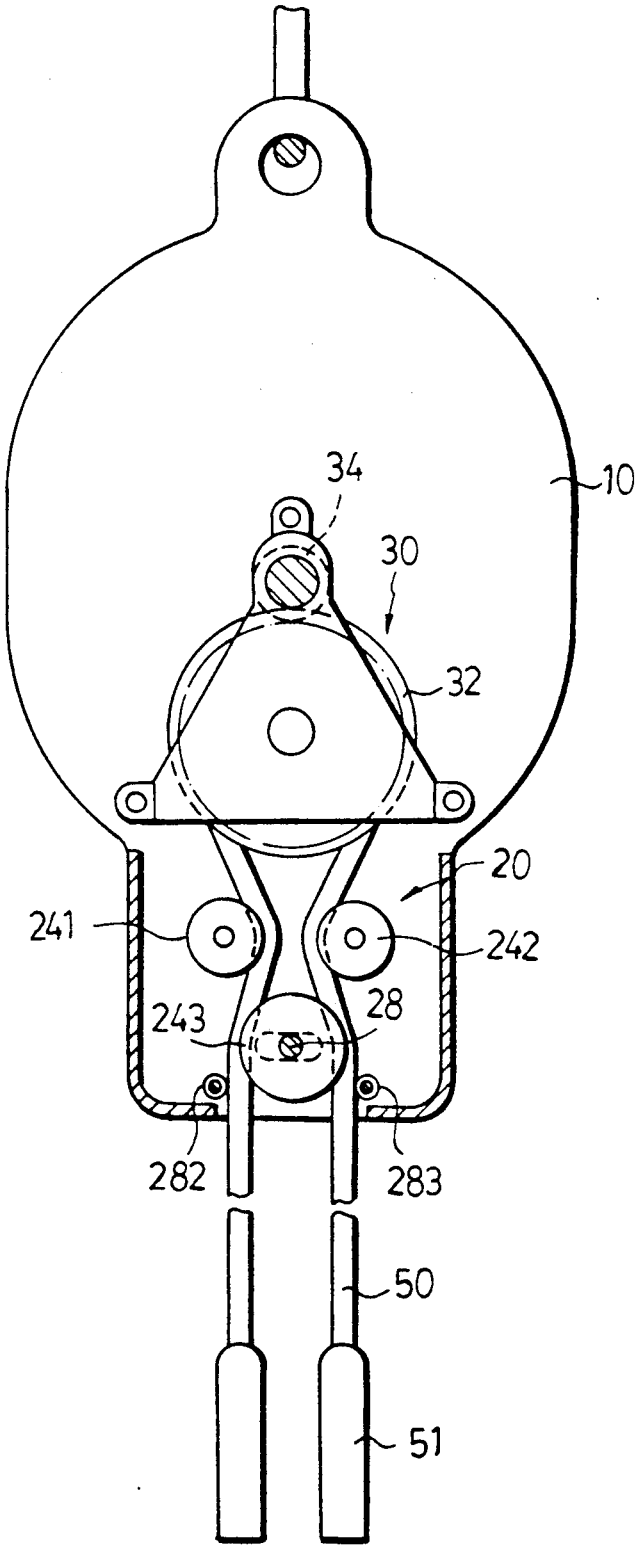
FIG. 9 is a cross sectional view of a third preferred embodiment of the emergency descent device of the present invention, shown before the descending portion of the cable is pulled.
Figure 10:
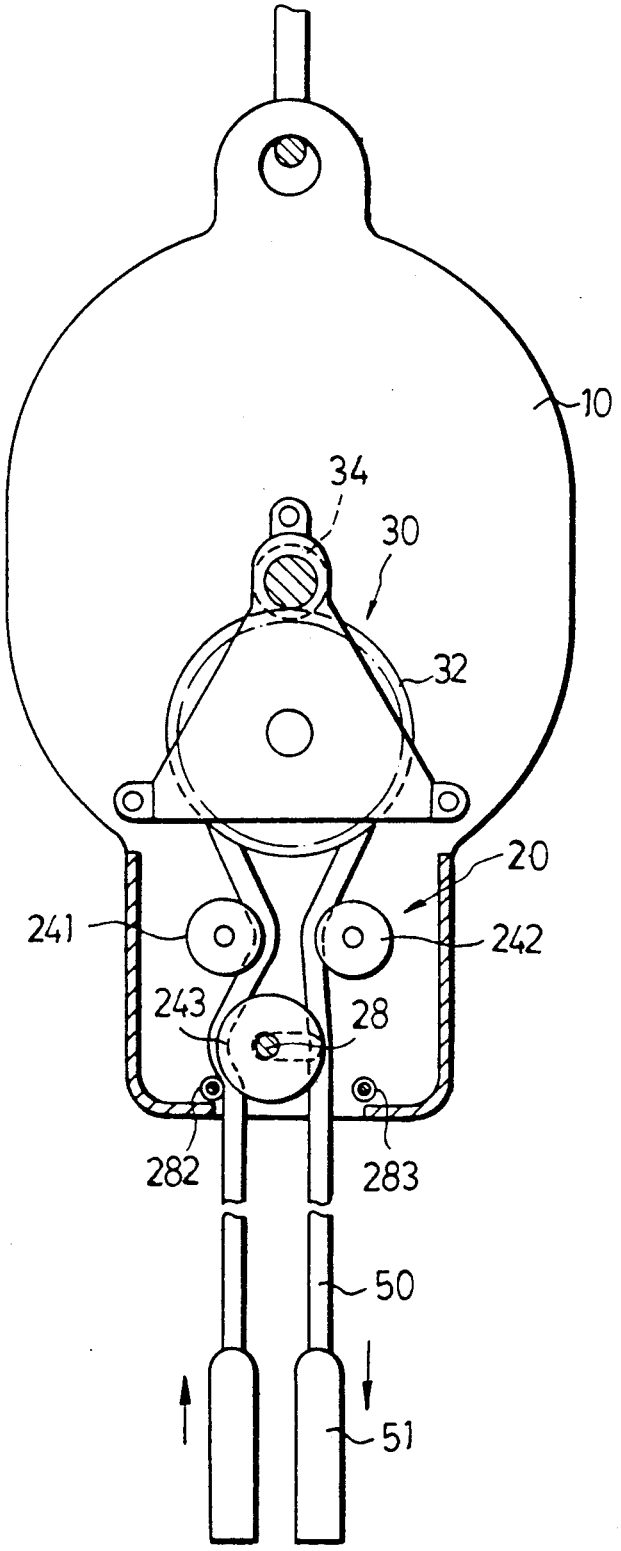
FIG. 10 is a cross sectional view of the third preferred embodiment of the emergency descent device of the present invention, shown after the descending portion of the cable is pulled.

Referring to FIGS. 7 and 8, the suspension pulley 42' is journalled in the second portion 10 by a known related art in which the active gear 33 is meshed with the inactive gear 34 of the rotating shaft 341. The guiding unit 20 includes a pair of upper rollers 241,242 and a central roller 26 sandwiched between two triangular supporting plates 222,221 at the apexes thereof and securely attached in the second portion 10 by a positioning post 28 passing through a center point cooperatively defined by these three rollers. A pair of lower rollers 282,283 is also provided below and on both sides of the central roller 26 whereat the upper rollers and the lower roller cooperatively define a substantially rectangular shape with the central roller being at the middle of the rectangular shape, as shown in FIG. 7.

The cable unit 50 extends around and engages frictionally with the suspension pulley 32 and its two end portions (50',50''), each of which extends between and through one of the pair of upper rollers 241,242 and the central roller 26 and between the central roller 26 and one of the lower rollers 282, 281.

When in use, the fastening ring 60 is hooked to a tall building, and the user fastens himself to a quick-fasten belt 51 attached to the descending portion of the cable 50 and lowers himself downward with his own weight while holding the ascending portion of the cable 50. At the same time, the cable 50 rotates the suspension pulley 32. Because the active gear 33 meshes with the inactive gear 34, the rotating shaft 341 is rotated, so that an extra frictional force occurs between the toothed roller 423,446 and the toothed surface 462 and the toothed sleeve member 442. In case the user is considerably heavy a bigger frictional force (a retarding force) against the rotation of the rotating shaft 41 will result.

During the user's descent by one end of the cable 6, the ascending portion of the cable 6 between the roller 241 and the central roller 26 and between the central roller 26 the roller 282 goes up, that is, is straightened, which correspondingly moves at least the central roller 26 from its initial place as illustrated in FIGS. 7 and 8.

The change of position of the upper rollers 241,242 and the central roller 523 causes an additional frictional force which arrests the quick descent of the cable 6 pinched between the two rollers 241, 26 and 282 so that a user of the present emergency descent device can slide downward with more ease and greater safety than he would with previous descent devices.

Figure 3:
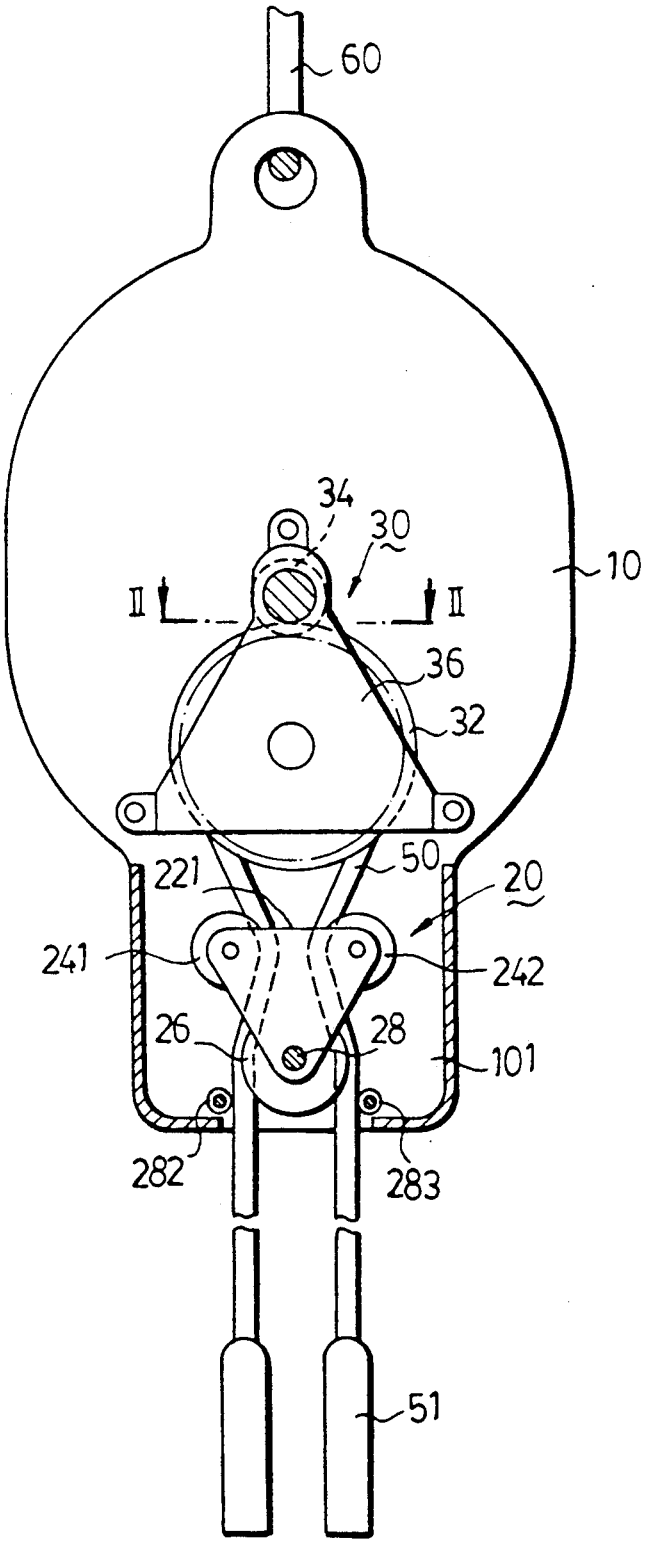
FIG. 3 shows the cross sectional view of a first preferred embodiment of the emergency descent device of FIG. 1 taken along the line I—I, illustrating the configuration before the descending portion of the cable is pulled.
Figure 4:
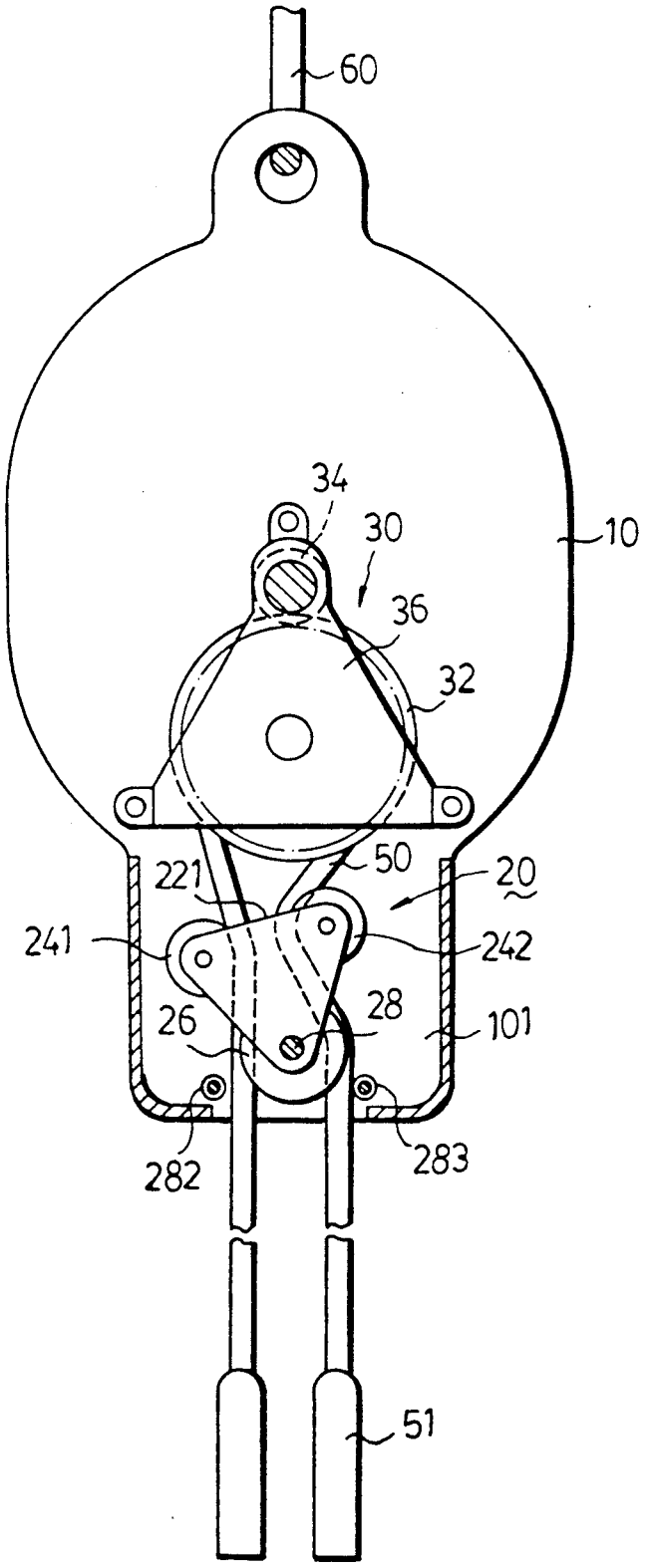
FIG. 4 shows the cross sectional view of the first preferred embodiment of the emergency descent device of FIG. 1 taken along the line III—III, illustrating the configuration after the descending portion of the cable is pulled.

In one preferred embodiment, the positioning post 281 of the cable guiding unit 20 is at the center of the central roller 26, as shown in FIGS. 3 and 4, the features and functions are not altered by the change of position of the secured post 281.

In another preferred embodiment, the positioning post 28 of the cable guiding unit 20 is journalled in an oblong hole in which the central roller 26 moves while in operation. In this preferred embodiment, the features and functions are similar to those explained in the first preferred embodiment of the present invention.

With the invention as explained, it is obvious to those skilled in the art that various modifications and variations can be made without departing from the scope and spirit of the present invention. It is therefore, intended that this invention be treated only as in the appended claims.

I claim:

1. An emergency descent device comprising: a casing having a top end, a bottom end, a first and a second portion;

a suspension pulley having a pulley shaft journalled in said second portion of said casing;

an active gear fixed around said suspension pulley;

a rotating shaft journalled in said first portion and having one end extending into said second portion, said end having an inactive gear fixed thereto which meshes with said active gear of said suspension pulley;

a rotation retarding assembly fixed to said rotating shaft in said first portion;

a cable extending around and engaged frictionally with said suspension pulley and having a descending end portion and an ascending portion extending thereof;

a cable guiding unit including at least two spaced upper roller and a central roller below a point between said two spaced upper rollers, said upper rollers and said central rollers guiding said descending portion between one of said upper rollers and said central roller and said ascending portion between the other one of said upper rollers and said lower roller;

a mounting unit provided in s id second portion and holding at least one of said upper rollers and said central roller in a triangular to permit at least said central roller to move from its original place when said descending portion frictionally passes through one of said upper rollers and said central roller thereby reducing the horizontal distance between said other one of said upper rollers and said central roller.

2. An emergency descent device as claimed in claim 1, wherein said mounting unit includes a pair of spaced triangular mounting plates holding said pair of upper rollers and said central roller therebetween substantially at the apexes thereof, and an engaging pin passing through a center point defined by said three rollers cooperatively.

3. An emergency descent device as claimed in claim 2, wherein said center point of said cable guiding unit is at the center of said central roller.

4. An emergency descent device as claimed in claim 3, wherein said center point is an oblong hole through said second portion and a mounting shaft of said cable guiding unit movably mounted in said second portion and passing through said oblong hole.

5. An emergency descent device as claimed in claim 1, wherein said emergency descent device further includes a fastening device attached to said casing so as to removably mount said casing to a tall building when in use.

6. An emergency descent device as claim in claim 1, wherein said rotation retarding device includes a hollow tubular member having an internal toothed surface and an opening confined by said internal toothed surface, a first retarding member, an external toothed sleeve member and a second retarding member, said hollow tubular being fixed in said first portion with said rotating shaft passing through the same, said first retarding member includes a plurality of arms each with a first toothed roller at its apexes thereof, and being fixed to said rotating shaft in said opening of said hollow tubular member, said first toothed rollers being meshed with said internal toothed surface of said tubular member, said second retarding member includes a plurality of arms each with a second toothed roller at its apexes thereof, and being fixed to said toothed sleeve member, said toothed sleeve member being sleeved rotatably on said rotating shaft adjacent to said first retarding member in said opening of said tubular member in such a manner that each of said second rollers being between a pair of adjacent said first toothed rollers, said first rollers being meshed with said toothed sleeve member and said second toothed rollers being meshed with said internal toothed surface of said tubular member.

7. An emergency descent device as claim in claim 1 wherein said an emergency descent device further includes a pair of lower rollers provided in said second portion underneath and on both sides of said central roller whereat said two upper rollers and said pair of lower rollers cooperatively define a substantially rectangular shape with said central roller at the middle of said rectangular shape, said ascending portion and said descending portion of said cable passing between said central roller and one of said lower rollers.

* * * * *